United States Patent [19]

Cochran et al.

[11] 4,000,393

[45] Dec. 28, 1976

[54] THERMAL PRINTHEAD ASSEMBLY

[75] Inventors: Michael J. Cochran, Richardson; Larry D. Propst, Rowlett; Richard D. Harris; Robert E. Belland, both of Richardson; John W. Richardson; Stephen P. Hamilton, both of Garland, all of Tex.

[73] Assignee: Texas Instruments Incorporated, Dallas, Tex.

[22] Filed: Aug. 29, 1974

[21] Appl. No.: 501,919

[52] U.S. Cl. ..... 219/216; 346/76 R

[51] Int. Cl.[2] ..... H05B 1/00

[58] Field of Search ..... 219/216, 543; 346/76 R; 197/1 R

[56] References Cited

UNITED STATES PATENTS

| | | | |
|---|---|---|---|
| 3,808,399 | 4/1974 | Payne et al. | 219/216 |
| 3,845,850 | 11/1974 | Herr et al. | 197/1 R |
| 3,855,448 | 12/1974 | Hanagatu | 219/216 |

*Primary Examiner*—C. L. Albritton

*Attorney, Agent, or Firm*—Harold Levine; Rene' E. Grossman; Richard P. Berg

[57] ABSTRACT

A method of assembling, positioning, and making connections to a thermal printhead is disclosed. A substrate is provided upon which heating elements or mesas are mounted. Leads from these heating elements are continued on the same side of the substrate as the one on which the elements are located. The leads are brought to terminal pads where connections may be made to the logic circuit which selectively energizes the heating elements to form numerals or characters on heat sensitive paper. A flat flexible cable with conductor ends exposed is held in place so that the exposed conductor ends make contact with the terminal pads of one or more of such substrates. The substrates and cable are clamped together by two metal plates. This entire assembly is mounted on a spring-loaded pivot arrangement so as to hold the heating elements against the heat sensitive paper on an advancing platen. Connections may be made between the cable conductors and the printing logic to allow the heating elements to be energized.

17 Claims, 6 Drawing Figures

THERMAL PRINTHEAD ASSEMBLY

BACKGROUND OF THE INVENTION

This invention relates to thermal printing and more particularly to means for assembling and making connections to a thermal printhead.

Thermal printing presents many advantages over mechanical means, particularly when implemented with electronic calculators. These advantages include lower cost of equipment and fewer moving parts, resulting in fewer mechanical failures. When a printed tape showing keyboard entries and calculated results is desired, a thermal printing system may be utilized to produce such an output. Using thermally sensitive paper which may be advanced as in conventional printers, a thermal printing system may accept signals from the calculator, decode those signals, use the decoded signals to selectively heat portions of the printhead, and thereby produce characters or numerals on heat sensitive paper.

With reference to FIG. 1, thermal printheads are generally produced with a plurality of heating elements or mesas 16 which may be selectively energized to produce a pattern of lines or dots. When the proper signals are provided to these elements or mesas 16 by means of metallized leads combined with proper advancement of the thermally sensitive paper 17 by means of a platten-advancing mechanism 18, characters or numerals are formed on the thermally sensitive paper 17. The heating elements 16 must be in very close contact with the paper 17 for satisfactory printing. These elements 16, as part of a thermal printhead assembly 14, are typically held in contact with the thermally sensitive paper 17 by a spring-loaded pivot arrangement 15.

The heating elements or mesas 16 are located on the one side of a substrate 10 which is usually ceramic or a similar material. The leads are generally brought through the ceramic substrate to the other side where pins 11 are attached. This combination of the ceramic substrate 10, the heating elements or mesas 16, and the leads 15 hereinafter described generally as a printer ceramic.

A standard lead frame 12 may be provided in which to insert the pins 11. From the lead frame 12, individual wire conductors 20 may be used to make connections to the printer logic 21. Because there is usually very little clearance between the substrate 10 and the platen 18 which advances the thermally sensitive paper 17 (not enough to locate a standard lead frame or other conventional connector), the leads from the heating elements 16 must be brought through the ceramic substrate 10. The lead frame 12 not only allows connection to the heating elements or mesas 16 but may also operate to hold the printer ceramic in the proper position. The printhead may also be held in place by attaching the ceramic substrate 10 to a pivoting bracket 15. A number of printer ceramic-lead frame assemblies may be installed adjacent to each other, in a printhead assembly 14, thereby providing for the printing of as many digits or characters as are desired.

There are a number of difficulties with such an arrangement. The process of bringing metal leads from the heating elements 16 through the ceramic substrate 10 and attaching pins 11 to them is more expensive than merely providing metallized leads on a single side of the substrate 10. In additon, the lead frames 12 are bulky and require a good amount of space in an area where space is at a premium. Further, the use of printer ceramic-lead frame assemblies often makes replacement of printer ceramics a difficult task since a housing 13 may first have to be disassembled. The attachment of the ceramic substrate 10 to a pivoting bracket 15 may require removal of screws, bolts, or other fasteners 19. Finally, because so much space on the ceramic substrate 10 is required by the pins 11 and lead frame 12, there is little room for thermal contact between the substrate 10 and metal parts of the thermal printer system which might act as heat sinks. The thermal contact that is available is some distance away from the heating elements or mesas 16 themselves, and the ceramic is not a good conductor of heat. The heating elements 16 of the thermal printer chip must cool quickly so that, as the thermally sensitive paper 17 is advanced, there will be no trailing effect. Unless proper heat sinking is available, the elements 16 will still be hot enough when the paper is advanced to leave a streak on the thermally sensitive paper 17. To avoid this problem, printing must be slowed down to allow time for the elements 16 to cool before the paper 17 is advanced, or heat sinking must be provided. Thus, proper heat sinks will allow faster operation.

SUMMARY OF THE INVENTION

With these difficulties in mind, the principal object of this invention is to develop a method of connecting the individual heating elements or mesas to the device which provides the encoded printing signals without being required to bring the leads through the substrate upon which the elements or mesas are located. The simplest and least expensive means of eliminating the requirement of bringing leads through the substrate is to deposit metallized leads on the same side of the substrate as the heating elements or mesas, and then make connections to the leads.

Another related object of this invention is to provide such a method for keeping all connections on one side of the substrate without requiring an increase in the size of the substrate. Referring to FIG. 1 once again, a larger substrate 10 which allows leads to run on one side until out of the area of the platen-advancing mechanism 18 would provide a unilateral lead arrangement, but would require a considerable increase in the size of the substrate 10 and a corresponding increase in the cost of the thermal printing system.

Still another object of this invention is to devise a thermal printhead assembly and conection scheme which will enable the individual printer chips, which are ganged to make up the entire printhead, to be easily removed and replaced. For a number of reasons, the present printer ceramic-lead fram assembly causes considerable difficultly in removing the printer ceramics. The ceramic with its pins in the lead frame must be physically pulled "out" of the spring-loaded lead frame. This requires some lateral motion by either the lead frame or the ceramic. Since the printer ceramic is in very close proximity to the advancing roller, the lead frame must be drawn away from the pins of the printer ceramic or the entire printer ceramic-lead frame assembly must be removed for replacement. In additon, the printer ceramic will most probably be attached to some pivoting bracket as in FIG. 1. If not, the lead frame must be so attached in order to hold the heating elements of the printer ceramic at the proper location for thermal printing. In either case, some fastening device will require removal in order to replace a printer ceramic.

A further object of this invention is to provide greater heat sink capability in the area of the heating elements or mesas.

In accordance with the objects of this invention, a printer ceramic is provided with connections made to the heater elements by metallized leads. Those leads are deposited on the side of the substrate on which the heater elements are located, and they are terminated on that side at a number of terminal pads. A flat flexible cable with exposed conductor ends is used to make connections between the printer ceramic and the printer logic. The exposed cable conductor ends are positioned to make contact with the terminal pads on the priner ceramics. The printer ceramic and flat cable are clamped together and positioned on a spring-loaded pivot arrangement. The clamping mechanism serves as a heat sink near the heating elements and allows the printer ceramic to be easily removed when necessary by merely loosening (not removing) the screws which hold the clamp plates together. The spring-loaded pivot mechanism maintains the proper position for the heater elements in relation to the thermal paper.

Other objects, advantages, and features of this invention will become apparent from the following detailed description taken in conjunction with the accompanying drawings.

IN THE DRAWINGS

DESCRIPTION OF THE PREFERRED EMBODIMENT

Figure 1:
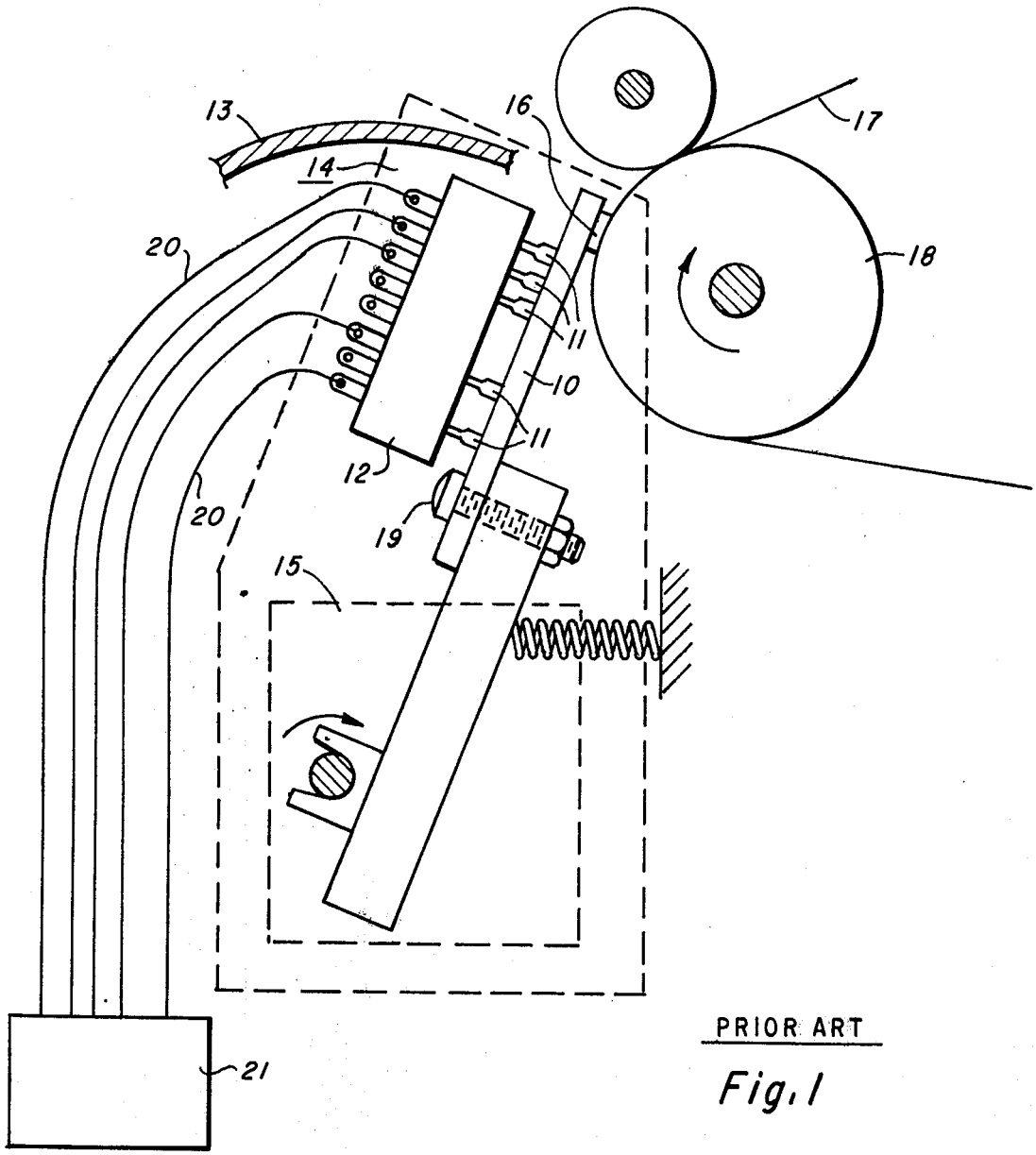
PRIOR ART Fig. 1
FIG. 1 is a profile view of a typical thermal printing system of the art prior to this invention.
Figure 2:
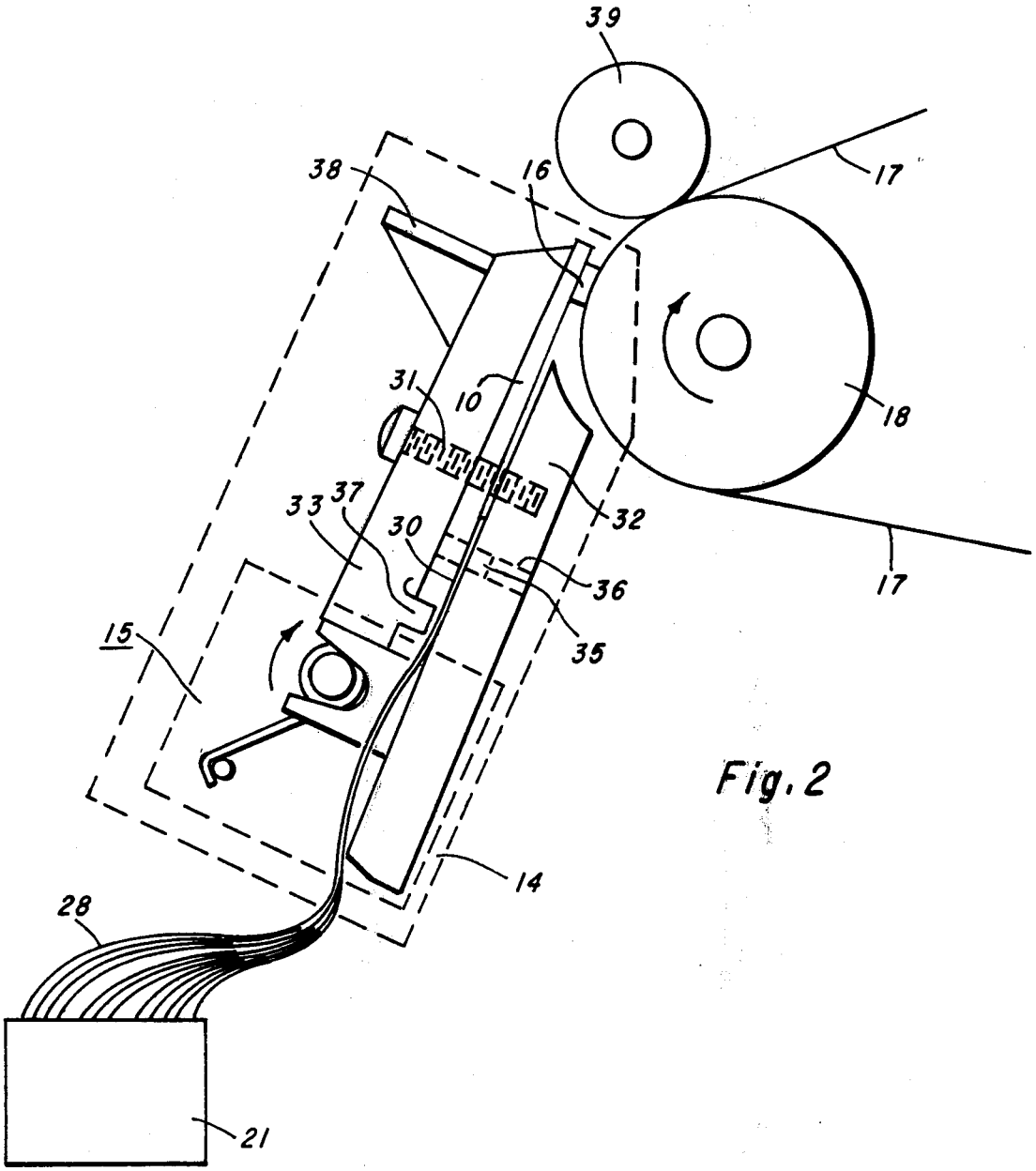
FIG. 2 is a profile view of a thermal printing system utilizing the concepts of this invention.

With reference to the drawings, FIG. 2 shows a typical thermal printing system embodying the principles of the present invention. Generally, the system consists of a thermal printhead assembly 14, printer logic 21 which provides signals to operate the printhead, and a platen-advancing mechanism 18 which advances the heat sensitive paper 17 in response to signals from the printer logic 21. A number of printer ceramics are located adjacent to each other and held in position to form the printhead assembly 14.

Figure 3:
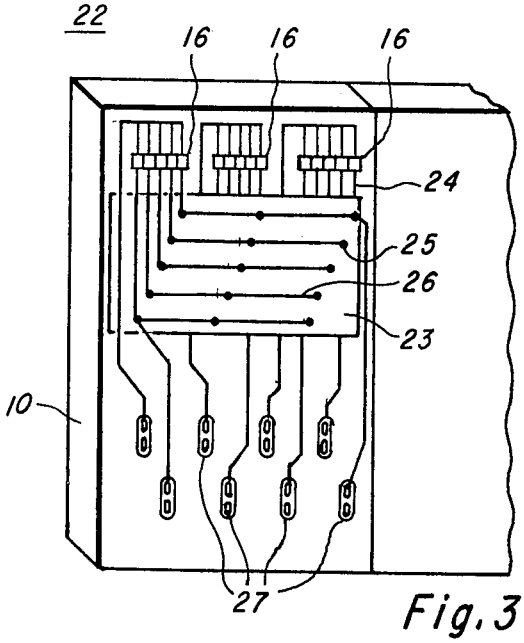
FIG. 3 is a pictorial representation of a printer ceramic.

Referring to FIG. 3, the printer ceramics 22 which make up the thermal printhead have a number of heater elements or mesas 16 which are mounted on a substrate 10 of ceramic or some other suitable material.

There are many different types of thermal printing devices; some use a number of linear heating elements to produce a pattern of lines on heat sensitive paper. The linear elements may be selectively energized to produce numbers or characters. Other thermal printing devices make use of an array of approximately square heating mesas to produce patterns of dots on heat sensitive paper. When individual one of these mesas, which may produce heat by semiconductor or resistive heating methods, are selectively energized, the dots produced on the heat sensitive paper form characters or numerals. The latter type of thermal printing system is fully described in U.S. Pat. No. 3,496,333, issued Feb. 17, 1970, to Earl G. Alexander, Stephen P. Emmons, and Jack S. Kilby, and assigned to the assignee of this invention, for "Thermal Printer".

Connections to the heating elements or mesas 16 are made by depositing metallized leads 24 on the ceramic substrate 10. Where necessary, a multi-layered lead arrangement may be utilized by the process of depositing an insulating layer 23 and the first set of leads 24 on the substrate 10, masking and selectively removing the insulating layer 23 at points of interconnection 25, and then depositing the second set of metallized leads 26 over the insulating layer 23. In other embodiments, the insulating layer 23 is applied only where desired, leaving points of interconnection 25 uncovered by the insulating layer 23. This selective covering is done by a screening process. In either embodiment an opening in the insulating layer or layers occurs whenever an interconnection is desired.

The leads are extended to a specified number of terminal pads 27 where they are terminated. The number of pads 27 on each printer ceramic 22 is dependent upon the number and types of thermal printing devices used. The pads 27 may be raised in relation to the surface of the substrate 10 as required to make good electrical connection.

Each printer ceramic 22 my accomodate several character of digit places in each of which a number of mesas 26 or heating elements will be located. A plurality of printer ceramics 22 may be used to produce as many characters or digits per printer line as is desired.

Figure 4:
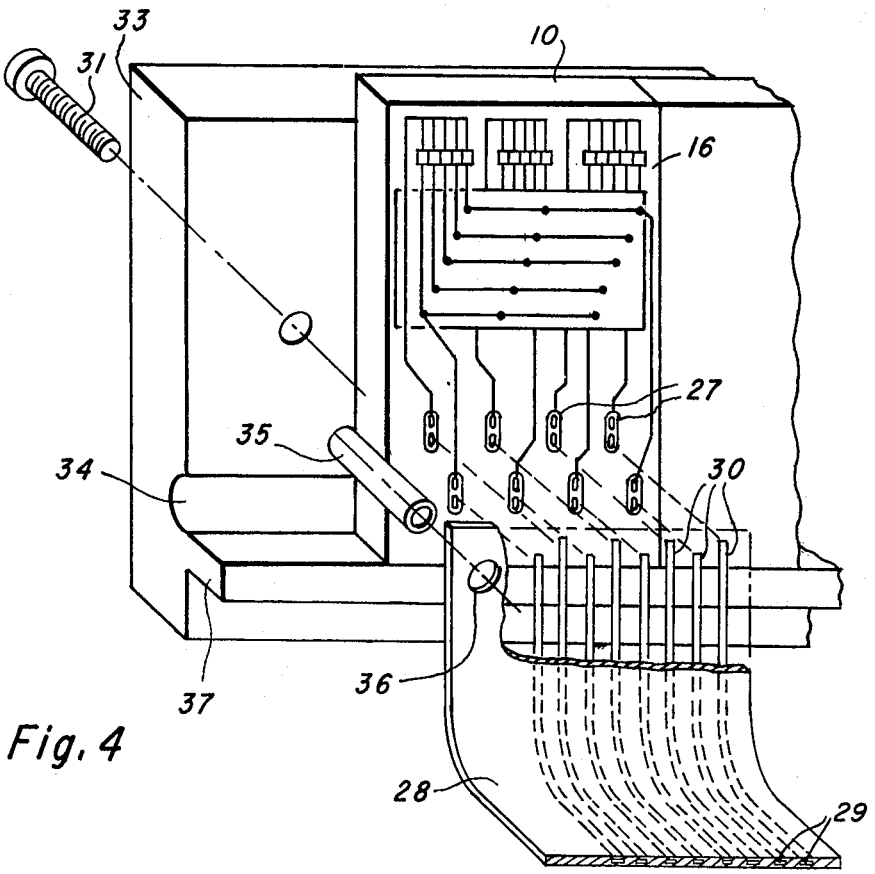
FIG. 4 is an expanded perspective view of the thermal printhead assembly.

With reference now to both FIGS. 3 and 4, as mentioned above, connections are made to the thermal printing elements or mesas 16 by metallized leads deposited on the ceramic substrate 10 of the printer ceramic 22. These leads are extended to a number of pads 27, where they are terminated. A flat flexible cable 28 which consists of a number of conductors 29 with exposed ends 30 is used to make electrical contact with the terminal pads 27. In order to make reliable, low resistance contacts, pressure is exerted on the exposed ends 30 of the cable 28 and the terminal pads 27 by tightening the holding screws 31 which fasten the clamp plate 32 (FIG. 2) and the printhead nest plate 33 of the thermal printhead assembly in place. If required, the slot 34 in the printhead nest plate 33 of the printhead assembly 14 may be filled with a resilient, semi-compressible substance which will cause greater pressure to be exerted on the exposed ends 30 of the cable 28 and the terminal pads 27. The flexible cable 28 is held in position by positioning pins 35 which protrude from the printhead nest plate 33 and match corresponding holes 36 in the cable 28 and in the clamp plate 32 (FIG. 2). Some type of positioning means is necessary in order to insure that the terminal pads 27 make contact with the proper exposed conductor ends 30. The cable 28 may be attached in a similiar manner to the printer logic 21 thus eliminating the need for solder or lead frames entirely. While FIG. 2 shows the profile of the thermal printhead assembly 14, FIG. 4 presents the printhead nest plate 33, the printer ceramic 22, one of the positioning pins 35, and the flexible cable 28 in a perspective view.

With reference again to FIG. 2, the printer ceramics 22 are located adjacent to each other with the heating elements or mesas 16 in contact with the thermally sensitive paper 17. The printer ceramics 22 are held in position by two metal plates, the printhead nest plate 33 and the clamp plate 32, which are screwed or bolted together with the printer ceramics 22 between them. These metal plates serves as heat sinks for the thermal printer as well as positioning the printer ceramics 22 properly with respect to the thermally sensitive paper 17 on the advancing platen 18. The printer ceramics 22 are held up by the shelf 37 which extends from the face of the printhead nest plate 33. The holding screws 31 or bolts may be loosened somewhat in order to allow the printer ceramics 22 to be easily removed from the thermal printhead assembly 14 for quick replacement. The printer ceramics 22 may be removed vertically by sliding them from between the clamping plates 32 and 33. The spring-loaded pivot mechanism 15 allows the entire thermal printhead assembly 14 to be pivoted back away from the platen 18. The printhead assembly 14 must be pulled back, using the handle 38 provided, so that the printer ceramic 22 being removed can slide past the paper guide roller 39. Such a guide roller 39 is not necessary to the operation of the invention if enough pressure is provided by the spring-loaded pivot mechanism 15. This mechanism presses the curved portion of the clamp plate 32 against the thermal paper 17 and advancing platen 18, thereby providing a friction force to keep the thermal paper 17 in a fixed relation to the platen 18. In other embodiments of the invention, the pressure from the heating elements 16 being held in place against the paper 17 and platen 18 is enough to prevent slippage of the paper 17 on the platen 18.

Figure 5:
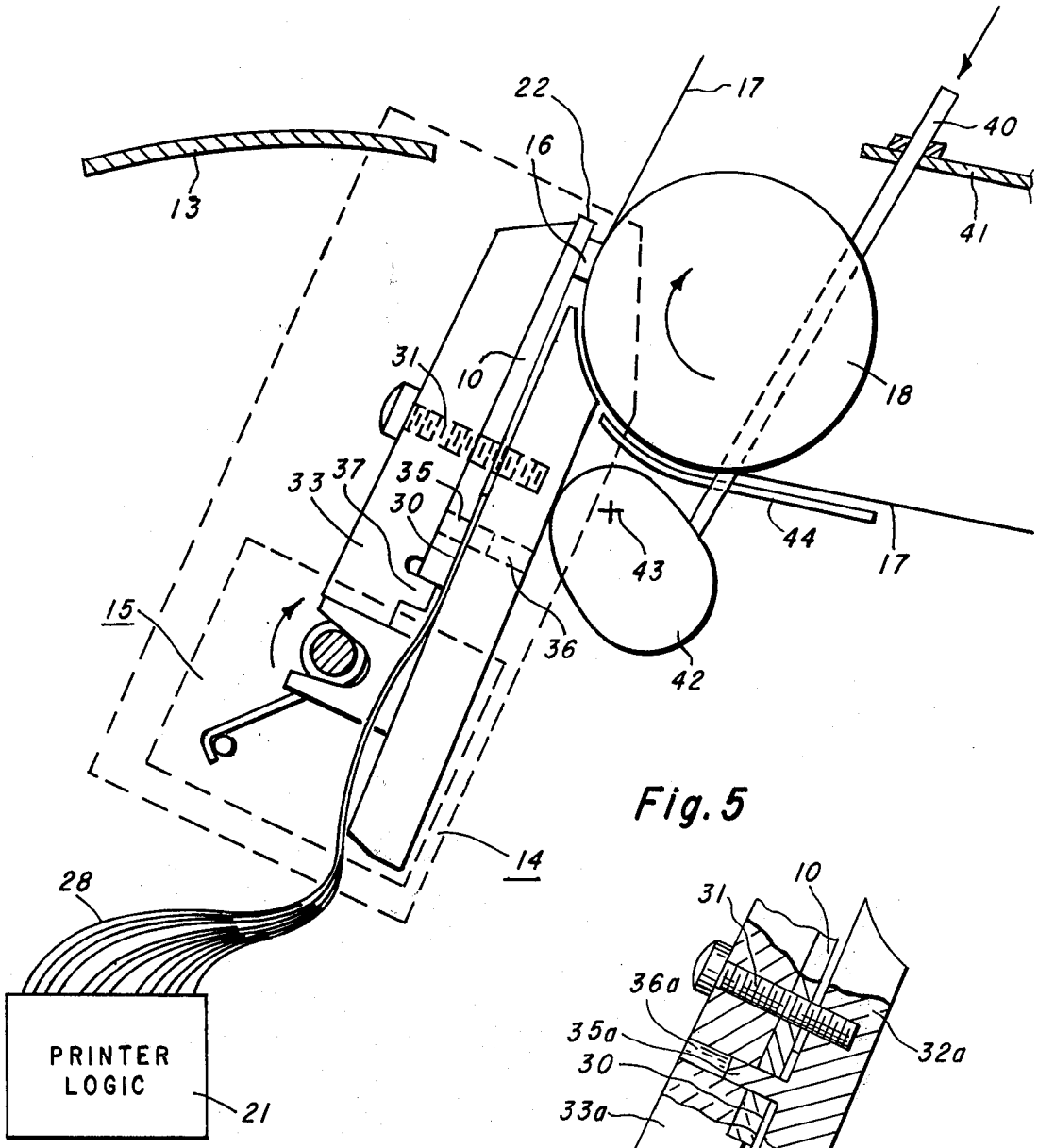
FIG. 5 is a profile view of an alternative embodiment of a thermal printing system utilizing the concepts of this invention.

With reference now to FIG. 5, an alternative embodiment of the invention is illustrated wherein the handle 38 used for pulling the thermal printhead assembly 14 away from the platen 18 is replaced by a rotating cam assembly which causes the printhead assembly 14 to be pushed away from the platen 18 when an axial force is applied to a push rod 40 which extends out of the printer case 41. Such a force, which may conveniently be applied by a user outside the printer case 41, causes the cam 42 to turn about its point of rotation 43, pushing the printhead assembly 14 away from the platen 18. Such operation is useful in removing printer ceramics 10 and in removing the thermal paper 17 without advancing the platen 18. Since the clamp plate 32 no longer applies a radial force against the platen 18 and paper 17, the paper 17 will slip easily on the platen 18. In this embodiment, there is no need to leave room between the front printer casing or housing 13 and the platen 18 so as to allow a user to reach the handle 38 as shown in FIG. 2. This embodiment further eliminates the need for a removable housing 13. Also illustrated in FIG. 5 is a paper guide 44. This guide 44, which is in close proximity to the platen 18, enables the user of the printer system to initially feed the thermal paper 17 by pushing it around the platen 18 and past the elements or mesas 16. Of course, when paper is being inserted, the printhead assembly 14 must be rotated away from the platen 18.

In both the embodiments, hereinabove described, the printhead nest plate 33 extends to the area of the substrate 10 on which the heating elements or mesas 16 are located providing heat sink capability in the area where it is most needed. This allows faster cooling of the elements 16 after each print cycle and enables printing to occur more rapidly.

Figure 6:
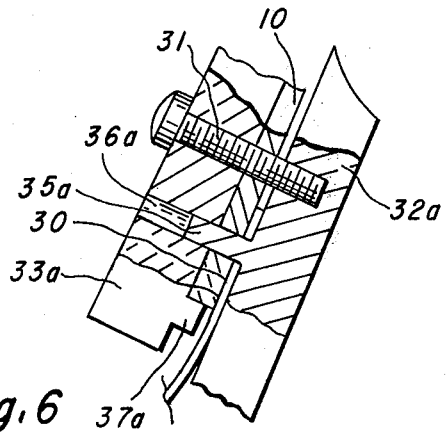
FIG. 6 is a partial cut-away profile view of an alternative embodiment of the mated nest and clamp plates.

While this invention has been particularly shown and described with reference to specific embodiments thereof, it will be understood by those skilled in the art that the foregoing and other changes in form and details may be made therein without departing from the spirit and scope of the invention. For instance, positioning pins 35may protude from clamp plate 32*a*, in lieu of pins 35 protruding from nest plate 33, the pins 35*a* matching holes in the cable 28 and holes 36*a* in nest plate 33*a*, as is shown in FIG. 6.

I claim:

1. A thermal printing system capable of printing numerals and characters on thermally sensitive paper or film, said thermal printing system comprising:
   a. a substrate;
   b. a number of heating elements or mesas located on one side of said substrate and thermally isolated from each other, said heating elements or mesas being capable of producing patterns consisting of lines or dots when selectively energized in close proximity to thermally sensitive paper or film;
   c. means for holding said heating elements or mesas in close proximity to said thermally sensitive paper or film;
   d. print logic means to produce signals which will, when supplied to said heating elements or mesas, selectively energize said elements or mesas, thereby producing numerals and characters on said thermally sensitive paper or film which correspond to data supplied to said thermal printing system;
   e. means for supplying said print signals to the heating elements or mesas, said means comprising:
      i. a plurality of electrically conductive terminal pads located on one side of said substrate;
      ii. a plurality of electrically conductive leads between said terminal pads and said heating elements or mesas, each one of said leads being electrically connected to one of the terminal pads and to at least one of the heating elements or mesas;
      iii. a flexible cable with conductors exposed at the ends and having at least one positioning hole in the flexible cable;
      iv. means for properly positioning said cable and causing said exposed conductors to make electrical contact with said terminal pads; and
      v. means for connecting said cable conductors to the print logic means.

2. A thermal printing system as defined in claim 1 wherein said electrically conductive terminal pads are raised above the surrounding surface of the substrate.

3. A thermal printing system as defined in claim 1 wherein said electrically conductive leads comprise a number of metallized strips deposited on the side of the substrate on which the heating elements or mesas are located.

4. A thermal printing system as defined in claim 3 further including a multi-layered lead arrangement, said multi-layered lead arrangement comprising:
   i. a number of layers of metallized strips isolated from each other; and
   ii. at least one layer of insulating material between each of said layers of metallized strips.

5. A thermal printing system as defined in claim 4 wherein said layers of insulating material have openings at points where interconnections are desired between at least one metallized strip of one layer and at least one metallized strip of at least one other layer.

6. A thermal printing system as defined in claim 1 wherein said flexible cable is flat, with conductors isolated from each other and positioned laterally in relation to each other.

7. A thermal printing system as defined in claim 1 wherein said means for positioning the flexible cable and causing electrical contact with said terminal pads comprises at least one positioning pin matching at least one of said positioning holes and having a fixed relation to said terminal pads.

8. A thermal printing system capable of printing numerals and characters on thermally sensitive paper or film, said thermal printing system comprising:

a. at least one printer ceramic, each of said printer ceramics comprising:
   i. a substrate:
   ii. a number of heating elements or mesas located on one side of said substrate and thermally isolated from each other, said heating elements or mesas being capable of producing patterns consisting of lines or dots when selectively energized in close proximity to thermally sensitive paper or film;
   iii. a plurality of electrical conductive terminal pads located on one side of said substrate; and
   iv. a plurality of electrically conductive leads between said terminal pads and said heating elements or mesas, each one of said leads being electrically connected to at least one of the terminal pads and to at least one of the heating elements or mesas;
b. print logic means to produce signals which will, when supplied to said heating elements or mesas, selectively energize said elements or mesas, thereby producing numerals and characters on said thermally sensitive paper or film which correspond to data supplied to said thermal printing system;
c. a flexible cable with conductors exposed at the ends and having at least one positioning hole in the flexible cable;
d. means for connecting said cable conductors to the print logic means;
e. a printhead nest plate for holding at least one of said printer ceramics;
f. a clamp plate;
g. means to fasten said printhead nest plate, printer ceramics, flexible cable, and clamp plates together with the exposed conductors of said cable in electrical contact with the terminal pads of each said printer ceramic; and
h. means for holding said heating elements or mesas in close proximity to said thermally sensitive paper or film.

9. A thermal printing system as defined in claim 8 wherein said clamp plate has at least one positioning hole therein matching at least one positioning hole in said cable.

10. A thermal printing system as defined in claim 9 further including at least one positioning pin, mounted on said printhead nest plate, matching at least one of said positioning holes in said cable and said clamp plate, and having a fixed relation to said terminal pads.

11. A thermal printing system as defined in claim 8 wherein said printhead nest plate has at least one positioning hole therein matching at least one positioning hole in said cable.

12. A thermal printing system as defined in claim 11 further including at least one positioning pin, mounted on said clamp plate, matching at least one of said positioning holes in said cable and said printhead nest plate, and having a fixed relation to said terminal pads.

13. A thermal printing system as defined in claim 8 further including:

a. a printhead nest plate having a slot therein; and
b. a resilient substance in said slot for creating greater contact pressure between said terminal pads and said exposed cable conductors when said printhead nest plate, at least one printer ceramic, flexible cable, and clamp plate are fastened together.

14. A thermal printing system as defined in claim 8 further including:

a. a clamp plate having a slot therein; and
b. a resilient substance in said slot for creating greater contact pressure between said terminal pads and said exposed cable conductors when said printhead nest plate, at least one printer ceramic, flexible cable, and clamp plate are fastened together.

15. A thermal printing system as defined in claim 1 wherein said means for positioning the flexible cable and causing electrical contact with said terminal pads comprises at least one elongated positioning member matching at least one of said positioning holes and having a fixed relation to said terminal pads.

16. A thermal printing system as defined in claim 9 further including at least one elongated positioning member mounted on said printhead nest plate, matching at least one of said positioning holes in said cable and said clamp plate, and having a fixed relation to said terminal pads.

17. A thermal printing system as defined in claim 11 further including at least one elongated positioning member mounted on said clamp plate, matching at least one of said positioning holes in said cable and said printhead nest plate, and having a fixed relation to said terminal pads.

* * * * *